United States Patent [19]

Wada

[11] Patent Number: 4,943,088

[45] Date of Patent: Jul. 24, 1990

[54] PICTURE BOOK WITH A PEN CONTAINING WATER-SOLUBLE INK

[76] Inventor: Yoshiomi Wada, 3-53-10, Higashi Oizumi-machi, Nerima-ku, Tokyo, Japan

[21] Appl. No.: 240,917

[22] Filed: Sep. 6, 1988

[30] Foreign Application Priority Data

Sep. 10, 1987 [JP] Japan ..... 62-137455

[51] Int. Cl.[5] ..... B42D 1/00; B42D 1/06; B42D 15/00; B42F 3/00

[52] U.S. Cl. ..... 281/39; 281/44; 283/97; 283/102

[58] Field of Search ..... 281/35, 38, 39, 44, 281/50; 283/97, 102

[56] References Cited

U.S. PATENT DOCUMENTS

| | | | |
|---|---|---|---|
| 117,433 | 7/1871 | Lake, Jr. | 281/39 |
| 2,036,341 | 5/1936 | Lemburg | 281/39 |
| 3,257,128 | 6/1966 | Schneider | 281/39 |
| 3,414,296 | 12/1968 | Schneider | 281/39 |
| 3,740,081 | 6/1973 | Whipperman | 283/97 |
| 3,918,174 | 11/1975 | Miller et al. | 283/102 |
| 4,092,449 | 5/1978 | Bernstein | 283/102 |
| 4,773,786 | 9/1988 | Pozzobon | 281/39 |

FOREIGN PATENT DOCUMENTS

| | | |
|---|---|---|
| 128316 | 11/1974 | Japan. |
| 114591 | 9/1980 | Japan. |

*Primary Examiner*—Douglas D. Watts
*Assistant Examiner*—Paul M. Heyrana, Sr.
*Attorney, Agent, or Firm*—Mason, Kolehmainen, Rathburn & Wyss

[57] ABSTRACT

The picture book is used with a pen containing a water-soluble ink, and at least a portion of the book is covered with resinous coating. Accordingly, while reading and reviewing the book, children may imaginatively paint or write on the book by means of the pen and thereafter wipe off the painted portion for reuse.

6 Claims, 3 Drawing Sheets

PICTURE BOOK WITH A PEN CONTAINING WATER-SOLUBLE INK

BACKGROUND OF THE INVENTION

1. Field of the Invention:

The present invention relates to a book, especially to a picture book used with a pen containing water-soluble ink so that a child may freely describe figures, letters or patterns on a leaf of the book with the pen and subsequently may wipe off same for reuse.

2. Description of the prior art:

It would be generally recognized that reading or reviewing various picture books by infants or children is effective in expanding their knowledge. Usually, such illustrated books include a variety of pictures and letters of interest to infants or children of various ages, printed on front and back covers, or intermediate pages portraying characters, stories or information.

In fact, it is often found that, upon reading or reviewing picture books, children usually have various images or associations connected to the contents of the books, and it is often considered desirable to give the child a chance to freely express these ideas. In other words, to enhance his or her creative, comprehensive or expressive power, it would apparently be important to make them sense, conceive and understand various matters in reading and to let the child freely express the imaginative subjects, so that they can clearly understand the matters and accumulate knowledge and experience from such reading.

Conventional educational books, however, do not usually provide any blank or specially treated portion in which a child may write or draw, so that scribbling on any portion of the book is usually considered to be to the detriment of the book. Nevertheless, it would seem apparent that free expression of imagination upon reading or reviewing a book would be of advantage in improving creative, contemplative or expressive ability.

SUMMARY OF THE INVENTION

It is, therefore, an object of the present invention to provide a picture book in which a child may paint or scribble his or her imaginary expressions directly on at least a portion of the book with a pen containing water-soluble ink and subsequently remove them by simply wiping off.

Another object of the invention is to provide the picture book capable of increasing children's interest in reading and painting or writing.

Still another object of the invention is to provide the picture book capable of improving a child's creative or expressive ability.

The picture book of the present invention consists of a front and back covers and a plurality of intermediate leaves filed between these covers, at least one surface of which is covered with a polymerized synthetic plastic or resinous coating. A child may paint on the coating of this book to freely express his or her ideas with a pen containing water-soluble ink, so that after the child's painting or writing on the leaf surface, the ink on the coating surface may be easily removed or erased by wiping the coating surface. In this way, while reading and reviewing the book, a child can freely draw pictures or letters from his or her imagination on pages or blank portions thereof, and subsequently remove same by wiping off for reuse.

These as well as other objects of the present invention will become apparent during the course of the following detailed description and appended claims.

DETAILED DESCRIPTION OF THE PREFERRED EMBODIMENT

Figure 1:
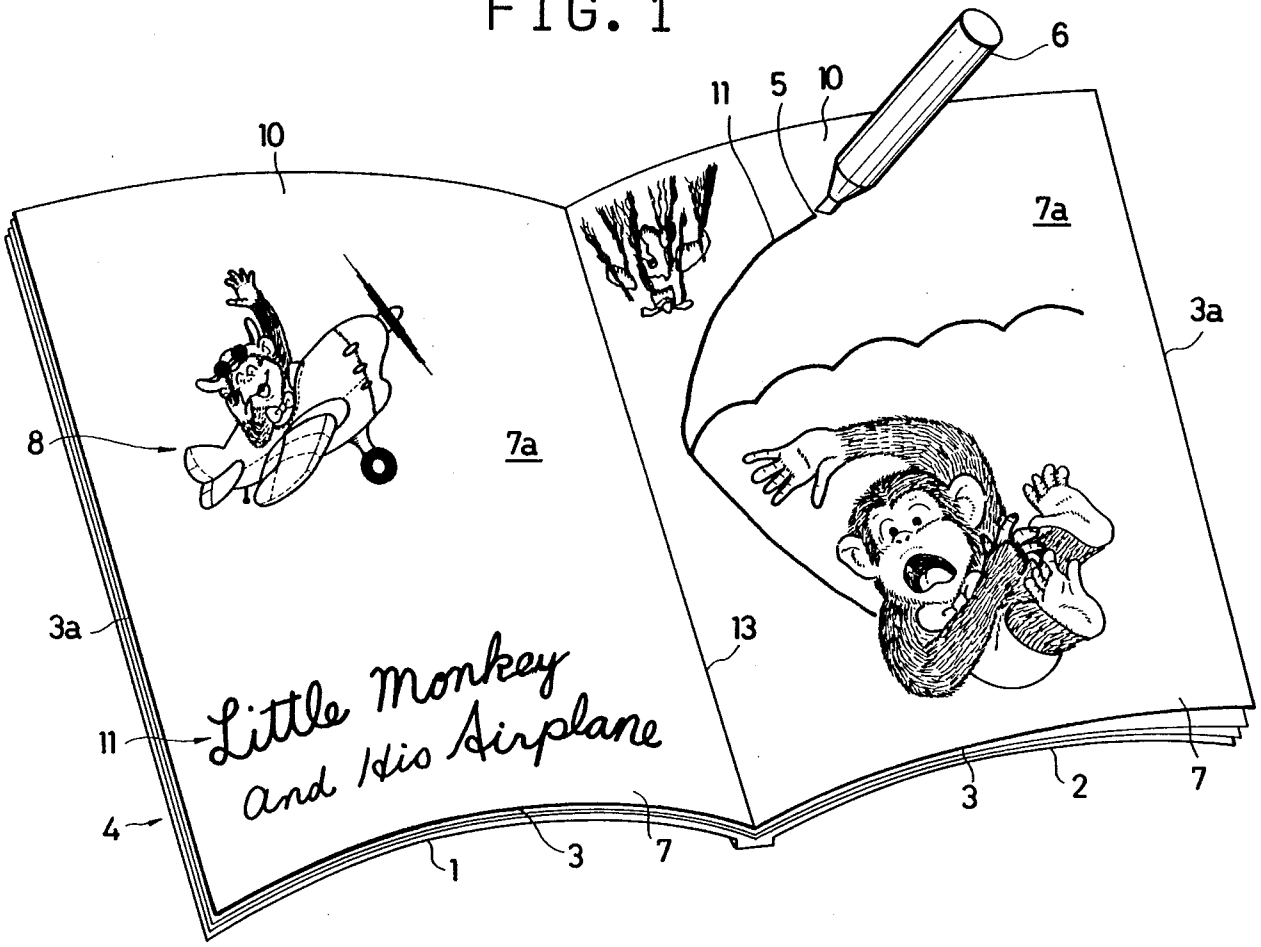
FIG. 1 shows a perspective view of the picture book according to the present invention used with a pen containing water-soluble ink.

Referring not to the drawings, according to the present invention, the picture book 4 is used with and a felt-tipped marker pen 6 containing water-soluble ink 5. The pen 6 may be of one of various types or colors. The book 4 consists of a front cover 1, a back cover 2, and several leaves 3 bound between these covers.

The water-soluble ink 5 may consist of emulsion paints or contain various pigments dispersed or dissolved in water or one or more alcohols, including titanium white or calcium carbonate as an assist or releasant. Generally, the ink essentially comprises acidic, basic or direct dyestuffs prepared by mixing some pigment with a water-soluble or dispesible binder which is selected from a group comprising milk casein, bean casein, dextrin, soluble starch, glue, sodium alginate, gum arabic, tragacanth gum, gelatine, polyvinyl alcohols, or a combination thereof. These dyestuffs can be diluted with water or one or more alcohols. If necessary, the ink is mixed with water-soluble alcoholic-, cellosolve- or glycolic-series additives to provide the adequate viscosity.

The ink preferably consists essentially of 3 to 12 weight %, especially 7 to 8 weight % of mixed pigment and a resin, 7 to 12 weight %, especially 10 weight % of an assist such as releasant in a solvent of mixed alcohols of 75 to 90 weight %, especially 82 to 85 weight %. According to the present invention, the water-soluble ink may include water dispersible ink.

Available coloring agents may comprise extended and coloring pigments. Extended pigments may include china clay, rubber powder, calcium carbonate and mica. Coloring pigments may include inorganic pigments such as ultramarine, cadmium yellow, red iron oxide, chrome yellow, lead white, titanium white, and carbon black, and organic pigments including azo-triphnylmethane-, quinoline-, anthraquinone-, flavocyanine-series pigments. However, in considering a danger of a child's ingestion of the ink, it would be desirable to utilize edible pigments allowed under regulations regarding food and sanitation.

Figure 2:
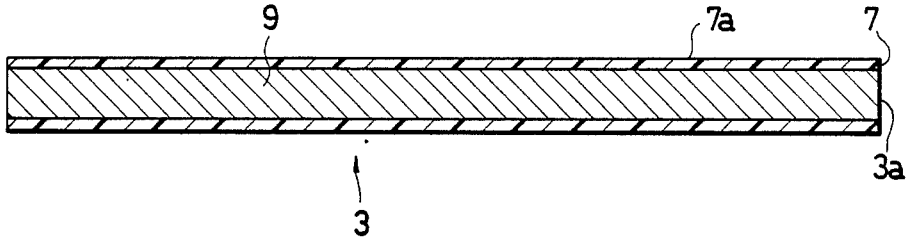
FIG. 2 is a sectional and partial view of an intermediate leaf in the book of the invention.
Figure 3A:
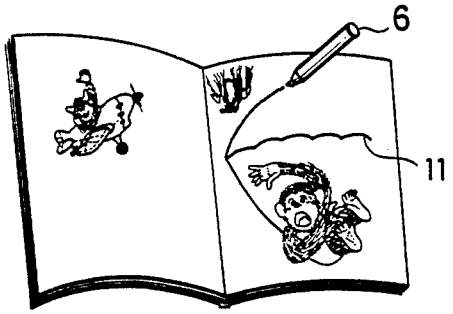
FIG. 3 illustrates the process which comprises the steps of painting a picture on the surface of a page of the book and thereafter erasing same.
Figure 3B:
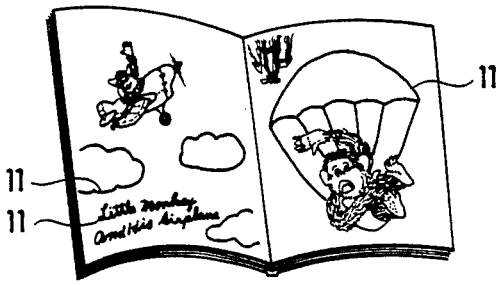
Figure 3C:
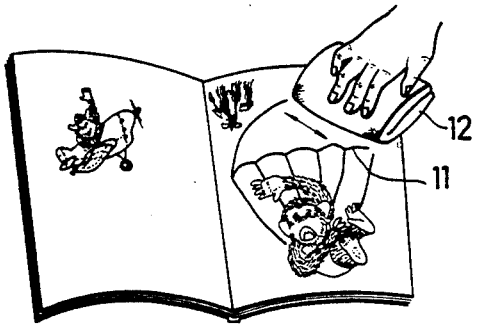
Figure 3D:
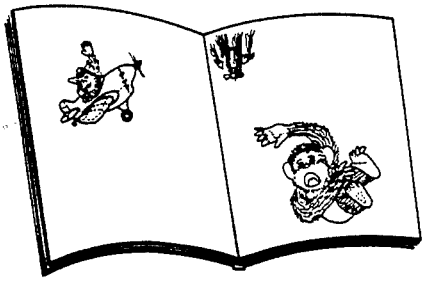

As shown in FIGS. 1 and 2, each intermediate leaf 3 consists of a base material 9 made of paper on which prints 8 are printed, such as words, numerals, pictures, etc., and a transparent synthetic plastic or resinous coating 7 attached to the base material 9, which may be of foreign or Japanese white or colored papers. The prints 8 printed on the base material 9 preferably represent various kinds of characters, pictures, figures or photographs which may be an object of children's interest. The coating 7 covers at least a part of all surfaces of the front or cover and the intermediate pages. The coating 7 is made of a liquid-impermeable material such as polypropylene, polyethylene, polyester or polyvinyl chloride. An eraser 12 made of soft material such as a piece of soft paper or fabric is used to wipe off the paint on the coating 7. In other words, the surface 7*a* of the coating 7 is formed such that the water-soluble ink 5, can be easily removed or wiped off from the surface 7*a*. The printed words or pictures and an adjacent blank portion 10 can be seen through the transparent coating 7. In this way, a child can freely paint, write, depict or scribble his or her images on the coating 7 and thereafter wipe off the paint for reuse.

Specifically, as shown in FIG. 3(*a*), drawing 11 can be made on the blank portion 10 by means of the pen 6 as the child freely uses his or her imagination in reference to the printed words or pictures or story on the pages. After completion of the drawing as shown in FIG. 3(*b*), it may be removed or erased by wiping an eraser 12 over the surface of the coating 7. Thus, the child can again draw on the surface. By tracing the letters or numerals printed on the base material 9 with the pen 6, the child can learn these letters or numerals. In this way, writing on the book is possible on the coating 7 over the printed letters or numerals of the base material as well as on the blank portion 10.

The foregoing embodiment of the present invention may be further modified in various ways. For example, the coating 7 may be applied not only to the intermediate pages but also to the reverse of the front cover or back covers. The coating 7 may be transparent and or colored or may be opaque with the indication on the surface of the coating. Also, the resinous coating may be formed in a multilayered structure. In this case, the base material 9 is first covered with a resin of low melting point such as polyethylene and then covered with another resin of high melting point such as polyester. Polyethylene applied on the base material 9 melts above a temperature of 80 degrees Centigrade, while the polyester of the outer layer does not melt up to 270 degrees Centigrade. Therefore, when the base 9 is treated for formation of the double layers in a temperature range between 80–270 degrees Centigrade and thereafter is press-rolled, the polyethylene is diffused into the paper fiber of the base material 9 for secure adhesion. The words or pictures 8 may be printed on the surface of the coating 7 in lien of or as well as on the surface of the base material 9.

In manufacturing the book of the present invention, the prints are first printed on the base material 9, the surface of which is subsequently coated with one or more resinous layers. In the coating process, a plastic film is overlayed on one or both sides of the base material 9, and then is pressed between a pair of rollers under heating. Otherwis, the base material 9 is inserted between two mating rollers, one of which is partially immersed into dissolved resin such as polyvinyl in a vessel, so as to automatically apply the resin to the surface of the base material during rotation of these rollers. The coating 7 may be formed by attaching a resinous laminate on the surface of the base material 9 with a transparent adhesive, or by spraying liquid resin. Then, the base material 9 is cut into a predetermined size and the resultant leaves are overlaid and filled with binders or staplers at the central portion 13 as shown in FIG. 1. The separately prepared cover and back pages are attached to the intermediate leaves. As seen in FIG. 2, at least a portion of the edge 3*a* of each intermediate page has a cut portion without coating due to mass production of the books.

As mentioned above, the picture book according to the present invention, a child can freely or imaginatively draw, write or paint on the book on his or her own expression while seeing or reading it, and thereafter the painted portions can may be easily erased for reuse of the book. It is, therefore, considered that the book is well suited enhancing children's creative, thinking or expressive power.

What is claimed is:

1. A picture book, having front and back covers and intermediate leaves for use with a water-soluble ink pen comprising:

a base material on which images of pictures, words, numerals, figures or patterns or combinations thereof can be printed; and a transparent and liquid-impermeable plastic coating attached to at least one side of the base material, whereby any images printed on the base material are visible through the transparent and liquid-impermeable plastic coating and from which the water-soluble ink, when applied via the removably attached pen to the transparent and liquid-impermeable plastic coating, is easily removed.

2. A picture book, as defined in claim 1, wherein both sides of said leaves are covered with said transparent and liquid-inpermeable plastic coating.

3. A picture book as defined in claim 1, wherein said book has a print on the surface of said covers, and intermediate leaves, said liquid-impermeable plastic coating on said covers and leaves being transparent so that said print is visible through said transparent coating and that markings may be made with said pen on the surface of the coating.

4. A picture book as defined in claim 1, said water-soluble ink consisting essentially of mixed pigment and a resin in a solvent of mixed alcohols.

5. A picture book as defined in claim 1, wherein said transparent and liquid-impermeable plastic coating is colored.

6. A picture book as defined in claim 1, wherein said base material is opaque and has a printed image on its surfaces.

* * * * *